US005572898A

United States Patent [19]

Horde et al.

[11] Patent Number: 5,572,898

[45] Date of Patent: Nov. 12, 1996

[54] MODULAR DIE TRANSFER SYSTEM

[75] Inventors: Boice F. Horde, Westland; Robert L. Decheim, Fenton, both of Mich.

[73] Assignee: Livernois Die and Automation, Dearborn, Mich.

[21] Appl. No.: 546,536

[22] Filed: Oct. 20, 1995

[51] Int. Cl.[6] ..... B21D 43/05

[52] U.S. Cl. ..... 72/405.16; 198/621.3

[58] Field of Search ..... 72/405.11–405.16, 72/405.01, 405.09; 198/621.3, 621.1

[56] References Cited

U.S. PATENT DOCUMENTS 4,032,018 6/1977 Wallis .
5,307,666 5/1994 Bianchi ..... 72/405

OTHER PUBLICATIONS

Wallis, "Transfer Die Technology," Livernois Automation Company (1991).
"Rotary Cam Series Transfer Systems," Livernois Automation Company, Brochure LAC–2003 (Feb. 1990).

*Primary Examiner*—Daniel C. Crane
*Attorney, Agent, or Firm*—Barnes, Kisselle, Raisch, Choate, Whittemore & Hulbert, P.C.

[57] ABSTRACT

A die transfer system for transferring workpieces through successive dies stations in a stamping press includes an elongated finger bar having spaced fingers for engaging workpieces at successive die stations. A drive module for reciprocating the finger bar laterally into and out of engagement with the workpieces at the die stations, and for lifting the workpieces above the level of the die stations for longitudinal transfer between die stations. The drive module has a crank arm coupled to the drive shaft for rotating the crank arm about an axis parallel to the finger bar. A cam plate is coupled to the finger bar and mounted for movement lateral to the crank arm axis and the finger bar. A cam follower is mounted on the crank arm and disposed in a slot on the cam plate, such that rotation of the drive shaft rotates the crank arm and propels the cam follower along the slot to move the cam plate and finger bar horizontally and vertically in sequence. A bearing element on the shaft is captured by structure on the cam plate to prevent horizontal movement of the cam plate and finger bar during motion in the vertical direction, and to prevent vertical movement during motion in the horizontal direction.

8 Claims, 4 Drawing Sheets

MODULAR DIE TRANSFER SYSTEM

The present invention is directed to die transfer systems, and more particularly to a modular arrangement for indexing workpieces through successive die stations in a stamping press.

BACKGROUND AND OBJECTS OF THE INVENTION

In die transfer systems of the subject character, a finger bar extends along one or both lateral sides of the die stations of a stamping press, and fingers extend inwardly from the finger bar or bars for engaging workpieces at the successive die stations. The finger bar or bars are driven longitudinally and laterally in synchronism with operation of the press for transferring workpieces through successive die stations and then out of the die. U.S. Pat. Nos. 4,032,018 and 5,307,666 each disclose die transfer systems of this general character, in which the finger bars are mechanically coupled by cam-and-follower arrangements to the ram of the stamping press for controlling operation of the finger bars.

U.S. application Ser. No. 08/280,089, assigned to the assignee hereof, discloses a die transfer system in which the drive mechanism for moving the fingers laterally into and out of engagement with the workpieces comprises at least two finger bar drive modules coupled to the finger bar and spaced from each other lengthwise of the finger bar. A drive shaft extends between and interconnects the two drive modules. Each of the drive modules includes a crank arm coupled to the drive shaft for rotating the crank arm about an axis parallel to the finger bar. A cam plate is coupled to the finger bar and mounted for movement lateral to the crank arm axis and the finger bar. The cam plate has orthogonal interconnected slots each extending in a direction lateral to the crank arm axis. A cam follower is mounted on the crank arm and disposed in the slots, such that rotation of the drive shaft rotates the crank arm and propels the cam follower along the cam plate slots in sequence so as to move the cam plate and the finger bar sequentially horizontally and vertically with respect to the die stations. The drive shaft is rotated in synchronism with operation of the stamping press, preferably by an electric servo motor and motor controller coupled to a sensor for monitoring position of the stamping press.

Although the die transfer systems disclosed in the noted patents and pending application have enjoyed commercial acceptance and success, further improvements remain desirable. For example, in the system disclosed in the pending application, there is a cam lock arrangement provided for preventing reverse horizontal movement of the finger bar and cam plate during vertical motion, which requires addition components and assembly time, thus undesirably increasing the cost of manufacture. It is a general object of the present invention to provide a modular die transfer system of the subject character that addresses this undesirable feature of the prior art.

SUMMARY OF THE INVENTION

A die transfer system for transferring workpieces between successive die stations in a stamping press includes at least one elongated finger bar having spaced fingers for engaging workpieces at successive die stations, a first drive mechanism for reciprocating the finger bar longitudinally for transferring workpieces between successive die stations, and a second drive mechanism for reciprocating the finger bar laterally horizontally and vertically into and out of engagement with the workpieces at the die stations. The second drive mechanism comprises at least one finger bar drive module coupled to the finger bar and a drive shaft connected to the drive module.

The drive module includes a crank arm coupled to the drive shaft for rotating the crank arm about an axis parallel to the finger bar. A cam plate is coupled to the finger bar and mounted for movement in both horizontal and vertical directions lateral to the crank arm axis and the finger bar. The cam plate has a cam slot, and a cam follower is mounted on the crank arm and disposed in the cam plate slot so that rotation of the crank arm propels the cam follower along the slot for moving the cam plate and finger bar in the horizontal and vertical directions.

To prevent horizontal motion of the cam plate and the finger bar during vertical motion thereof, the shaft on which the crank arm is mounted is horizontally captured by the cam plate during motion of the cam plate in the vertical direction. This is accomplished in accordance with the preferred embodiments of the invention by providing a rotatable bearing on the crank arm shaft for co-rotation with the shaft about the axis of the shaft, and structure on the cam plate for capturing engagement with the bearing. In one embodiment of the invention, the bearing comprises a roller mounted on an end of the shaft and axially extending therefrom into the cam plate slot. Thus, in this embodiment, the cam plate slot functions not only to cooperate with the crank arm for moving the finger bar, but also with the crank arm shaft and roller for preventing horizontal movement of the cam plate and finger bar during motion thereof in the vertical direction. In another embodiment, the bearing radially encircles the crank arm shaft at a position adjacent to the cam plate, and the structure that operatively captures the bearing comprises bars mounted on the cam plate adjacent to the slot for radial engagement with the bearing on the shaft.

BRIEF DESCRIPTION OF THE DRAWINGS

The invention, together with additional objects, features and advantages thereof, will be best understood from the following description, the appended claims and the accompanying drawings in which:

DETAILED DESCRIPTION OF PREFERRED EMBODIMENTS

Figure 1:
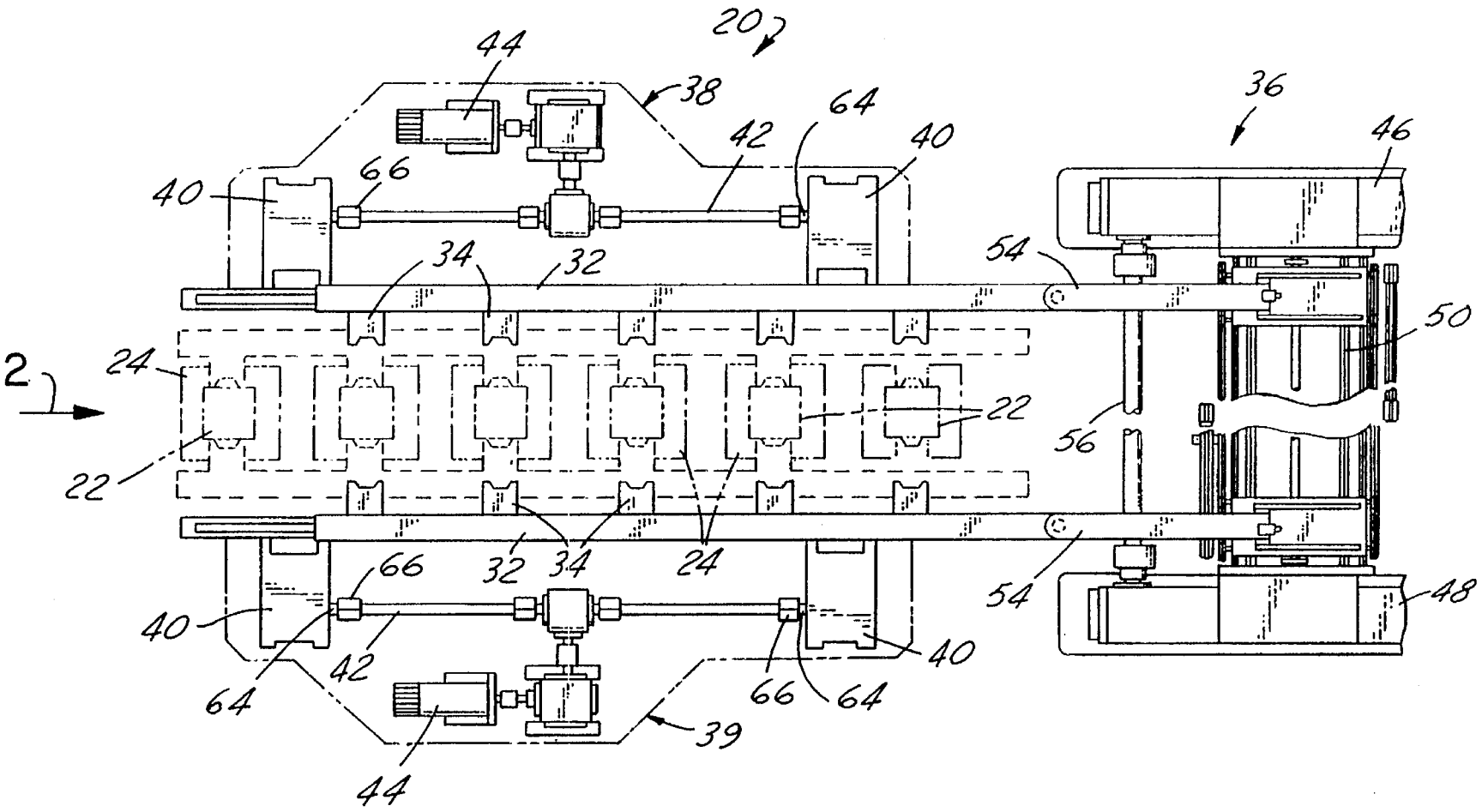
FIG. 1 is a plan view of a die transfer system in accordance with one presently preferred embodiment of the invention.
Figure 2:
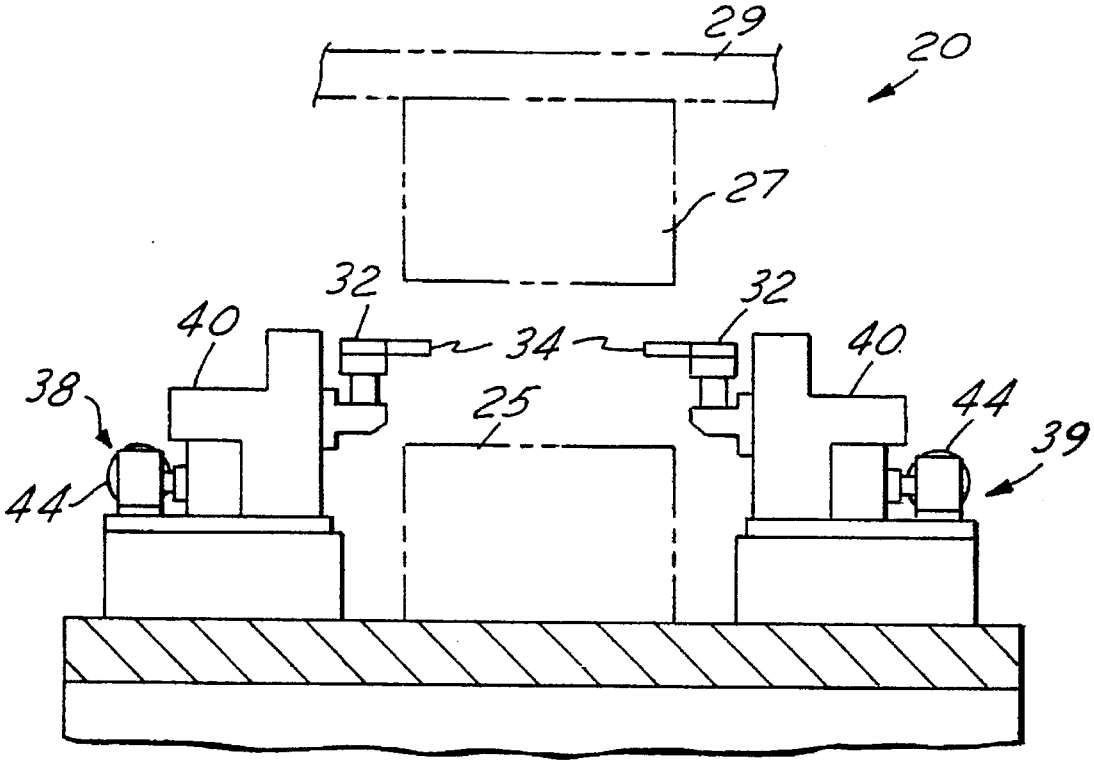
FIG. 2 is an end elevational view of the die transfer system illustrated in FIG. 1 viewed from the direction 2 in FIG. 1.

FIGS. 1 and 2 illustrate a die transfer system 20 in accordance a presently preferred embodiment of the invention for transferring workpieces 22 between successive die stations 24. Die stations 24 are positioned on the lower die 25 (FIG. 2) of a stamping press having an upper die 27 coupled to a press ram 29. Returning to FIG. 1, transfer system 20 includes a pair of elongated parallel finger bars 32 each having a plurality of longitudinally spaced fingers 34 for engaging workpieces 22 at successive die stations 24. (It will be appreciated, of course, that directional adjectives such as "longitudinal" and "lateral" are taken with reference to the direction of motion of workpieces 22 between and through successive die stations 24.) A longitudinal or transfer drive module 36 is positioned at one end of transfer system 20, and is coupled to finger bars 32 for reciprocating the finger bars back and forth in the direction of their length, thereby sequentially transferring workpieces through the successive die stations. A pair of laterally opposed drive modules 38, 39 are coupled to finger bars 32 for reciprocating the finger bars laterally into and out of engagement with workpieces at the die stations, and for lifting the workpieces above the level of the die stations for longitudinal motion between the die stations.

Lateral drive modules 38, 39 are mirror images of each other. Each lateral drive module 38, 39 has at least two finger bar modules 40 coupled to the associated finger bar 32 and spaced from each other lengthwise of the finger bar. A drive shaft 42 extends between and interconnects drive modules 40. Drive shaft 42 is rotated in synchronism with operation of the stamping press by an electric servo motor 44 and associated controller coupled to a sensor for monitoring position of the stamping press. Longitudinal drive module 36 includes a pair of belt drive mechanisms 46, 48 interconnected by a bridge 50. A pair of carriages 52 are mounted on bridge 50, and are connected by arms 54 to respective finger bars 32. A motor (not shown) and a drive shaft 56 interconnect belt drives 46, 48 for driving the belt drives reciprocally in the longitudinal direction. To the extent thus far described, transfer system 20 is similar to those disclosed in above-noted U.S. application Ser. No. 08/280,089, and in application Ser. No. 546,538, the disclosures of which are incorporated herein by reference.

Figure 4:
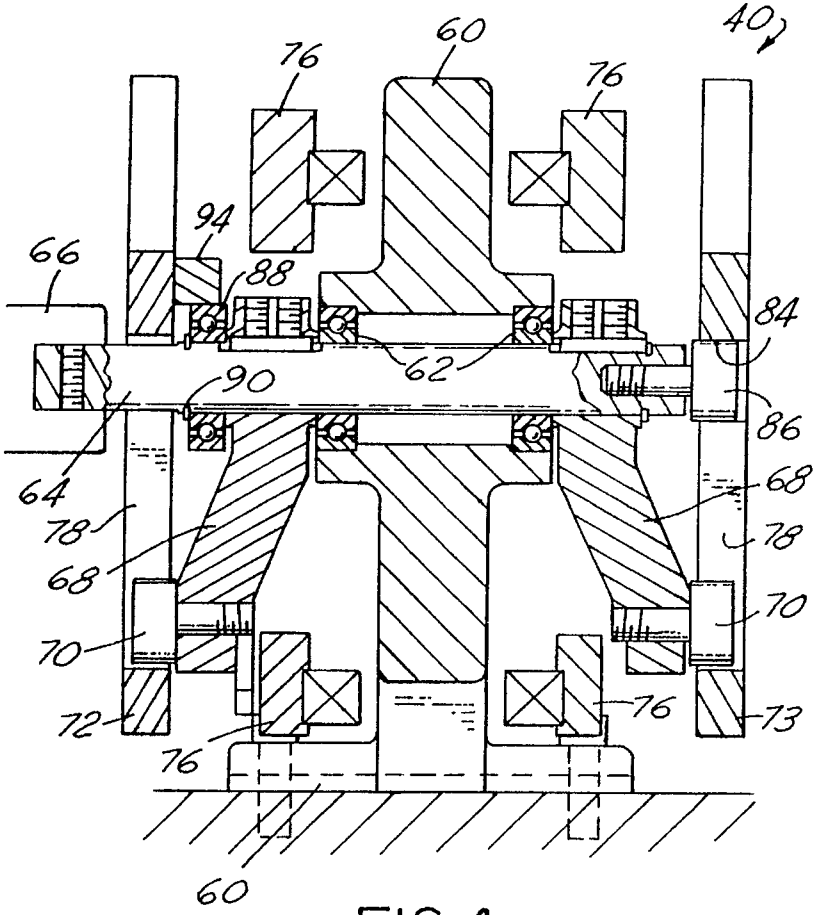
FIG. 4 is a partially fragmented sectional view taken substantially along the line 4—4 in FIG. 3.
Figure 3:
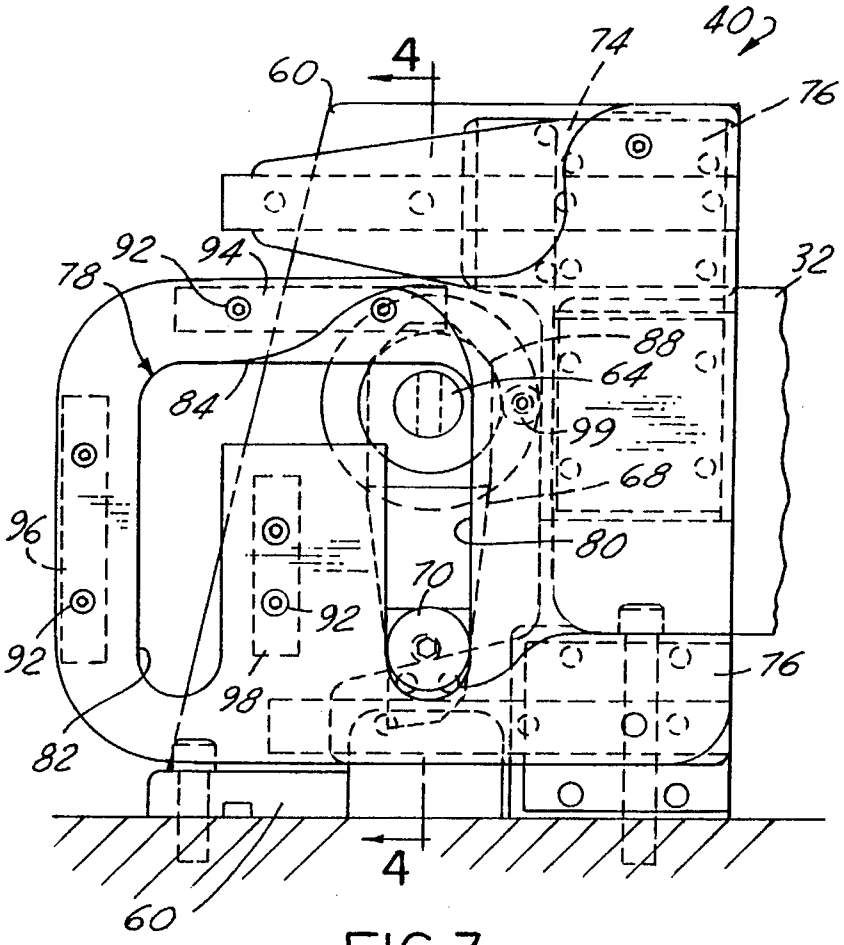
FIG. 3 is a side elevational view of a transfer module in the die transfer system illustrated in FIGS. 1 and 2.

FIGS. 3–4 illustrate drive module 40 in greater detail. A support frame 60 carries a pair of spaced roller bearings 62 that rotatably support a stub shaft 64 that is removably and coaxially connected to drive shaft 42 (FIG. 1) by an axial coupler 66. A pair of crank arms 68 are affixed to and extend radially from stub shaft 64 on axially opposed sides of support frame 60 for co-rotation with the stub shaft. (Alternatively, and as illustrated in the above-referenced applications, a gear transmission may be disposed between the stub shaft coupled to the drive shaft and a stub shaft that carries the crank arms, the two stub shafts being parallel to but offset from each other.) A cam roller 70 is rotatably mounted on the end of each crank arm 68. A cam plate 72, 73 is mounted on each side of support 60 outboard of the associated crank arm 68. Each cam plate 72, 73 is mounted by a vertically oriented linear bearing 74 between a pair of vertically spaced horizontally oriented linear bearings 76, which in turn are mounted to center support 60. Each cam plate 72, 73 is thus free to move vertically along the axis of associated linear bearing 74, and horizontally along the parallel axes of associated linear bearings 76.

Each cam plate 72, 73 has an inverted U-shaped cam slot 78 formed therein. Each cam slot 78 includes spaced parallel vertical reaches or portions 80, 82, and a horizontal portion 84 that interconnects the upper ends of vertical portions 80, 82. Each crank arm roller 70 is received within an associated cam plate slot 78. A roller 86 is mounted at one end of stub shaft 64 coaxially therewith for co-rotation with the stub shaft and for rotation about its own mount independently of the stub shaft. Roller 86 is disposed within slot 78 of cam plate 73. At the opposing end of stub shaft 64 adjacent to coupling 66, stub shaft 64 extends through slot 78 of cam plate 72. A roller bearing 88 radially encircles shaft 64 adjacent to cam plate 72, being mounted on the stub shaft against the adjacent crank arm 68 by a snap ring 90 for co-rotation with the stub shaft and for rotation independently of the stub shaft around the axis of the stub shaft. On the internal face of cam plate 72 adjacent to crank arm 68, there are mounted by screws 92 a linear bar 94 parallel to but vertically offset from portion 84 of cam slot 78, and a pair of bars 96, 98 parallel to but horizontally spaced on either side of vertical portion 82 of cam slot 78. A roller 99 (FIG. 3) is carried by cam plate 72 adjacent to but spaced from upper end of slot portion 80. Bars 94, 96, 98 and roller 99 are disposed for radial engagement with bearing 88 on stub shaft 64.

Figure 6:
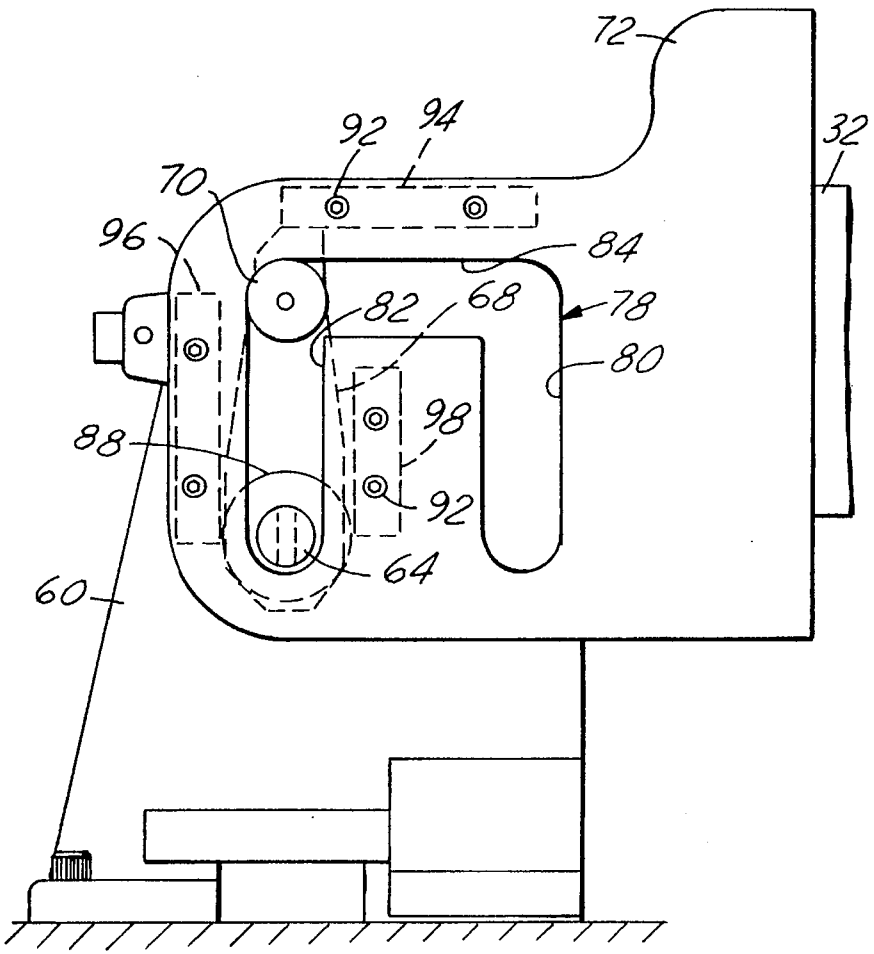
FIGS. 5–6 are schematic illustrations of the crank arm, follower plate and cam locking mechanism of the present invention in sequential stages of operation.
Figure 5:
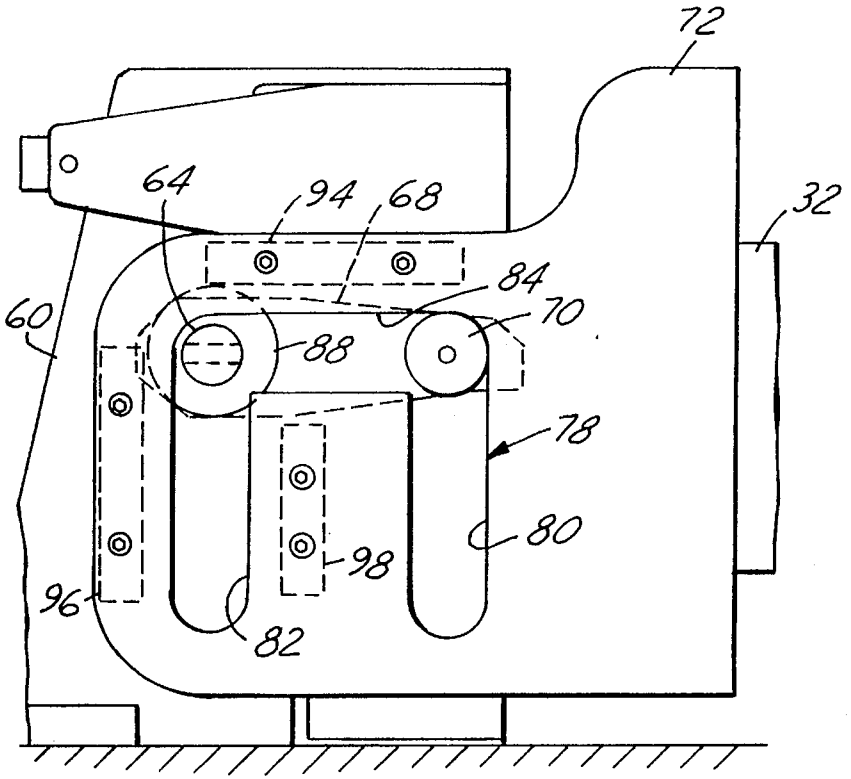

Sequential positions of stub shaft 64, crank arms 78, cam plate 72 (and cam plate 73) and finger bar 32 are illustrated in FIGS. 3, 5 and 6. FIG. 3 illustrates the staring position, with cam plate 72 and finger bar 32 fully retracted outwardly and downwardly with respect to die stations 24 and lower die 25 (FIGS. 1 and 2). Roller 99 engages bearing 88 and prevents horizontal inward movement of cam plate 72 (and 73). In order to move finger bar 32 laterally inwardly to engage work pieces 22 (FIG. 1) and lift the work pieces off of the die stations 24, servo motors 44 are energized so as to rotate stub shaft 64 counterclockwise from the position illustrated in FIG. 3 through the position illustrated in FIG. 5 to the position illustrated in FIG. 6. During the initial rotation from the position illustrated in FIG. 3 to the position illustrated in FIG. 5, cam rollers 70 on the ends of crank arms 68 engage the edges of cam slot portions 80 adjacent to finger bar 32 so as to propel cam plates 72, 73 and finger bar 32 laterally inwardly or to the right in FIG. 3 to the position in FIG. 5. During such motion, roller 86 on one end of stub shaft 64 in cooperation with slot 78 on cam plate 73, and bearing 88 on the opposing end of shaft 64 in cooperation with bar 94 on the adjacent cam plate 72, function to support cam plates 72, 73 and finger bar 32 against the force of gravity. That is, cam plate 73 on the right side of module 40 as viewed in FIG. 4 is supported by roller 86 in engagement with the upper edge of the associated cam plate slot portion 84, while cam plate 72 on the left side is viewed in FIG. 4, and as viewed in FIGS. 3 and 5, is supported by bearing 88 and bar 94 adjacent to the upper edge of associated cam plate slot portion 84. When crank arms 68 reach the horizontal orientation illustrated in FIG. 5, inward motion of cam plates 72 and finger bar 32 is complete. At this point, the upper ends of bars 96 on cam plate 72 engages bearing 88, and the upper end of slot portion 82 on cam plate 73 engages roller 86, to prevent further inward horizontal motion.

Continued rotation of stub shaft 64 counterclockwise as viewed in FIGS. 3, 5 and 6 propels crank arm rollers 70 along the upper edges of cam slot portions 84 so as to lift cam plates 72, 73 and finger bar 32 from the position illustrated in FIG. 5 to the position illustrated in FIG. 6. During such vertical motion of cam plates 72, 73 and finger bar 32, motion of the cam plates and finger bar in either horizontal direction is prevented by cooperative engagement between the cam plates and the bearing elements carried by the stub shaft. That is, on the right side of module 40 as viewed in FIG. 4, roller 86 on the end of stub shaft 64 cooperates with the horizontally laterally opposed edges of cam slot portion 82 in cam plate 73 for preventing horizontal motion of the cam plate and finger bar as the cam plate moves from the position illustrated in FIG. 5 at which roller 86 is disposed at the upper end of slot portion 82, to the position illustrated in FIG. 6 at which roller 86 is disposed at the lower end of associated cam slot portion 82. At the same time, bars 96, 98 on cam plate 72 cooperate with bearing 88 on stub shaft 64 to prevent horizontal movement of the associated cam plate. That is, between the position illustrated in FIG. 5 and the position illustrated in FIG. 6, cam plate 72 carries bars 96, 98 past bearing 88 on stub shaft 64, so that the bearing engages the inner radial faces of the bars to prevent horizontal motion in either direction. Thus, bearing elements (roller 86 and roller bearing 88) on stub shaft 64 cooperate with structure on the cam plates (either cam plate slot 78, or bars 94, 96, 98 and roller 99 adjacent to the cam plane slot) for preventing motion of the cam plates and finger bars in one direction while being propelled by the crank arm in the orthogonal direction.

The structure hereinabove describes operation in the same way during motion in the reverse direction - i.e., from FIG. 6 to FIG. 5 to FIGS. 3 and 4. That is, when moving vertically downwardly from FIG. 6 to FIG. 5, horizontal motion in both directions is inhibited by abutment of bearing 88 against bars 96, 98 at cam plate 72, and by abutment of roller 86 against the side edges of slot portion 82 at cam plate 73. When thereof or moving laterally outwardly from FIG. 5 to FIGS. 3 and 4, vertical motion is inhibited by abutment of bearing 88 against bar 94 at cam plate 72 and by abutment of roller 86 against the upper edges of slot portion 84 at cam plate 73. Finally, when such lateral outward motion is completed, cam plate 72 is supported against vertical motion as shown in FIG. 3 by abutment of the inner end of bar 94 against bearing 88 and abutment of bearing 88 against roller 99. Cam plate 73 is supported against horizontal and vertical movement of abutment of roller 86 against the upper outward edge of slot portion 80 and the forward upper edge of slot portion 84.

It will thus be appreciated that the invention hereinabove describe fully satisfies the objects and aims previously set forth. Furthermore, modifications and variations are contemplated without departing from the spirit and broad scope of the invention. For example, in elongated transfer systems in which several modules 40 are required on each side of the transfer line, the end modules may be as illustrated in the drawings of the present application, while the center module(s) would have stub shaft 64 extending entirely therethrough for connection by appropriate couplings to the end modules. In such a module, a bearing 88, a set of bearing bars 94, 96, 98 and a roller 99 would be disposed at each end of the stub shaft, and bearing roller 86 would not be employed. Similarly, bearing elements other than a roller 86 or roller bearing 88 may be mounted on shaft 64 for cooperation with the cam plate(s). In some transfer systems, the conveyor need only be employed along one note of the lower die.

We claim:

1. In a die transfer system for transferring workpieces between successive die stations in a stamping press, and including elongated bar means having spaced means for engaging workpieces at successive die stations, first means for reciprocating said bar means longitudinally for transferring workpieces between successive die stations, and second means for reciprocating said bar means horizontally into and out of engagement with workpieces at the die stations and vertically upwardly and downwardly with respect to the die stations, said second means comprising:

at least one drive module coupled to said bar means, drive shaft means coupled to said drive module, and means coupled to said drive shaft means for operating said drive shaft means and said drive module in synchronism with operation of the stamping press, said drive module comprising:

crank arm means, second shaft means mounted for rotation about a fixed axis within said drive module and having said crank arm means rotatably coupled thereto, means operatively coupling said second shaft means to said drive shaft means for rotating said second shaft means and said crank arm means about said fixed axis parallel to said bar means, cam plate means coupled to said bar means and mounted for movement laterally of said axis both horizontally and vertically with respect to said axis, cam slot means extending along said cam plate, and cam follower means disposed in said slot means and coupled to said crank arm means, the improvement bar preventing motion of said cam plate means and said bar means in one direction during motion thereof in the orthogonal direction comprising means on said cam plate capturing said second shaft means in one direction during motion of said cam plate means in the orthogonal direction so that said second shaft means cooperates with said capturing means to prevent said orthogonal motion of said cam plate means and said bar means.

2. The system set forth in claim 1 wherein said second slot means comprises bearing means mounted on said second shaft means for co-rotation therewith, and wherein said shaft-capturing means comprises means on said cam plate means for capturing engagement with said bearing means.

3. The system set forth in claim 2 wherein said bearing means comprises rotatable bearing means carried by said second shaft means for co-rotation with said second shaft means about said fixed axis and being rotatable about said shaft axis independently of said second shaft means.

4. The system set forth in claim 3 wherein said rotatable bearing means is mounted on said second shaft and disposed in said cam plate slot.

5. The system in claim 3 wherein said slot means is of U-shaped configuration on said cam plate means, having parallel first and second slot portions and a third slot portion outer connecting said first and second slot portions, said second shaft means extending axially into said slot means.

6. The system in claim 5 wherein said bearing means radially encircles said second shaft means, and wherein said capturing means comprises means carried by said cam plate means adjacent to said slot means for radial abutting engagement with said bearing means.

7. The system in claim 1 wherein said second shaft means is an axial extrusion of said drive shaft means.

8. The system in claim 7 wherein said means operatively coupling said shaft means comprises a coupler coaxially coupling said shaft means to each other.

* * * * *